United States Patent [19]

Fujisawa

[11] 4,376,586

[45] Mar. 15, 1983

[54] DRIVE MECHANISM FOR PRINTER CARRIAGE AND INK RIBBON

[75] Inventor: Tadao Fujisawa, Mishima, Japan

[73] Assignee: Tokyo Electric Co., Ltd., Tokyo, Japan

[21] Appl. No.: 227,536

[22] Filed: Jan. 22, 1981

[30] Foreign Application Priority Data

Jan. 31, 1980 [JP] Japan ..... 55-9333

[51] Int. Cl.[3] ..... B41J 33/04

[52] U.S. Cl. ..... 400/229; 400/335; 400/236; 400/320

[58] Field of Search ..... 400/223, 229, 235, 236, 400/335, 194, 195, 196, 196.1, 320

[56] References Cited

U.S. PATENT DOCUMENTS 3,995,731 12/1976 Miller et al. ..... 400/229 X
4,232,976 11/1980 Bernardis et al. ..... 400/196.1
4,300,847 11/1981 Hoffman et al. ..... 400/229

OTHER PUBLICATIONS

*Xerox Disclosure Journal,* vol. 2, No. 6, Nov./Dec. 1977, p. 43, "Cable/Pulley Drive For Printer Carriage", Mario G. Plaza.

*Primary Examiner*—Paul T. Sewell
*Assistant Examiner*—Daniel J. Roock
*Attorney, Agent, or Firm*—Frishauf, Holtz, Goodman and Woodward

[57] ABSTRACT

A drive mechanism for printer carriage and printing ribbon includes a roller for feeding an ink ribbon, a shaft rotatably mounted on the printing carriage, first and second pulleys rotatably mounted on the shaft, first and second one-way clutches for transmitting the rotation of the first and second pulleys in a predetermined direction to the shaft, a cord stretched on the first and second pulleys so as to cause translational movement of the shaft and first and second pulleys in first and second directions. In this drive mechanism, the pulleys are respectively rotated in opposite directions when they are translationally moved in the first or second direction. The rotation of these pulleys in a predetermined direction is transmitted through the first and second one-way clutches to the shaft, and the rotation thereof is transmitted through a coupler to the ink ribbon feed roller.

13 Claims, 6 Drawing Figures

DRIVE MECHANISM FOR PRINTER CARRIAGE AND INK RIBBON

BACKGROUND OF THE INVENTION

This invention relates to a drive mechanism for driving a printer carriage carrying a printing head and also feeding an ink ribbon.

Serial printers, in which an ink ribbon cassette is removably mounted on a carriage carrying a printing head, are known in the art. The carriage is driven at the time of a printing operation along lines of printing by a drive mechanism having a cord or cable. Meanwhile, the ink ribbon in the ink ribbon cassette is driven in accordance with the movement of the carriage by a drive force transmission mechanism provided separately from the drive mechanism for driving the carriage, for instance as disclosed in British Pat. No. 1,493,479. The provision of the drive force transmission mechanism for feeding the ink ribbon entirely separately from the drive mechanism for driving the carriage, however, increases the number of component parts and complicates the construction.

An object of the invention is to provide a drive mechanism for driving the printer carriage and which can feed an ink ribbon by making use of a driving force for driving a printer carriage.

SUMMARY OF THE INVENTION

In one form of the invention, there is provided a drive mechanism for printer carriage and printing ribbon, which comprises a rotatable ribbon feeding member adapted to feed a printing ribbon carried in a cassette, a carriage moving member rotatably mounted on a printer carriage, a cord-like member provided in frictional contact with the carriage moving member, drive means for driving the carriage moving member along a line of printing while causing rotation of the carriage moving member by driving the cord-like member, and one-way clutch means for transmitting the rotation of the carriage moving member in a predetermined direction to the rotatable ribbon feeding member.

According to the invention, the rotation of the carriage moving member used for moving a printer carriage is transmitted to a rotatable ribbon feeding member to feed the printing ribbon, so that the number of component parts required for the ribbon drive is reduced.

DETAILED DESCRIPTION

Figure 1:
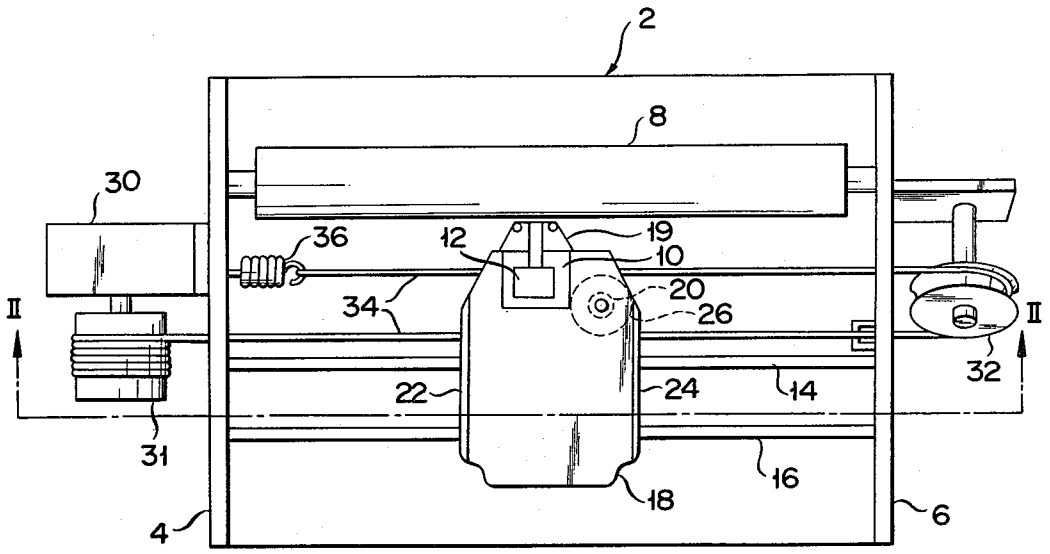
FIG. 1 is a top view showing a serial printer incorporating an embodiment of a drive mechanism according to the invention.
Figure 2:
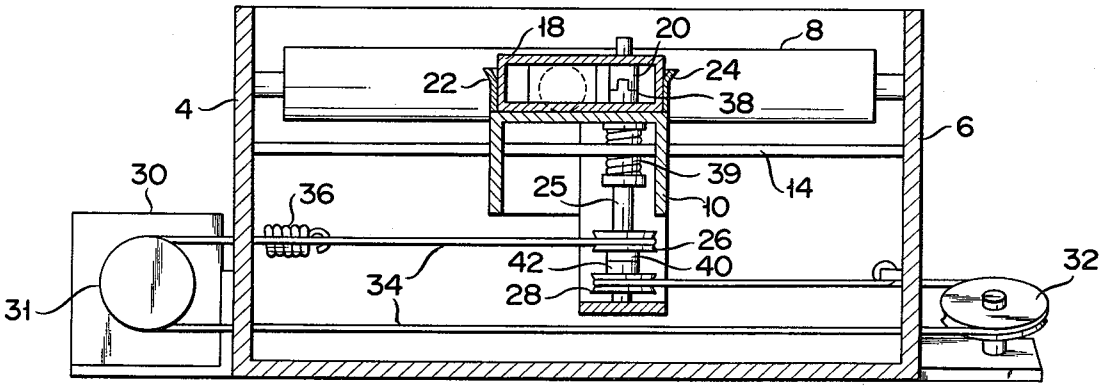
FIG. 2 is a sectional view of the serial printer taken along line II—II in FIG. 1.

FIGS. 1 and 2 show schematic views of a serial printer provided with a drive mechanism for driving a printer cartridge and a printing ribbon according to the invention. The serial printer includes a casing 2 having side walls 4 and 6, a platen 8 rotatably supported at its opposite ends on the side walls 4 and 6, a printer carriage 10 carrying a printer head 12 and a pair of supporting rods 14 and 16 secured at their opposite ends on the side walls 4 and 6. The printer carriage 10 is slidably supported on the supporting rods 14 and 16. As is clearly shown in FIG. 2, the printer carriage 10 includes a pair of resilient arms 22 and 24 for supporting by a snap action a ribbon cassette 18 which includes an ink ribbon 19 and a ribbon transfer roller 20. The printer carriage 12 further includes a rotatable shaft 25 carrying two pulleys 26 and 28 rotatably mounted thereon. These pulleys 26 and 28 co-operate with a motor 30 provided on the side of the side wall 4, a pulley 32 provided on the side of the side wall 6 and a cord or wire 34 sequentially stretched on the pulleys 26, 28 and 32 and a shaft 31 of the motor 30 in order to drive the printer carriage 10 along the supporting rods 14 and 16. As is clearly shown in FIG. 3, the cord 34 has one end connected to one end of a spring 36 which has its other end secured to the side wall 4, and the cord 34 is, after being passed round the pulley 26, wound several turns on the shaft 31 and then passed round the pulleys 32 and 28 in this order and connected at the other end to the side wall 6.

Figure 4:
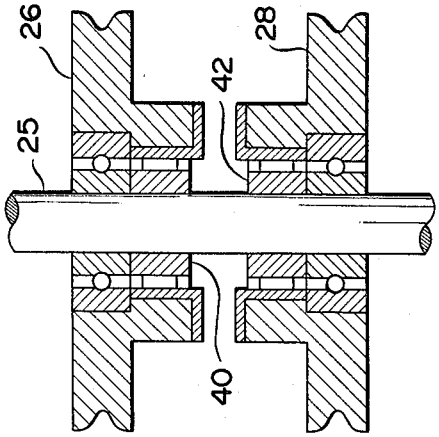
FIG. 4 is a sectional view showing pulleys and one-way clutches used in the mechanism of FIG. 1.

In this embodiment, the pulleys 26 and 28 are coupled through respective one-way clutches 40 and 42 to the shaft 25 such that the shaft 25 is rotated in a first predetermined direction with the rotation of the pulleys 26 and 28 in a first predetermined direction and is not rotated with the rotation of the pulleys 26 and 28 in a second predetermined direction opposite to the first predetermined direction. In this embodiment, the pulleys 26 and 28 are mounted on the shaft via bearings as shown in FIG. 4 for suppressing radial forces exerted onto the one-way clutches 40 and 42. When the pulley 26 or 28 is driven in the direction of arrow B or in the opposite direction, this translational motion is transmitted through the bearing mounted on the pulley 26 or 28 to the shaft 25, so that no undesired forces are exerted to the one-way clutches 40 and 42. Also, in this embodiment a coupling member 38 is provided at the top of the shaft 25 such that it is movable in the axial direction of the shaft 25.

When the ribbon cassette 18 is mounted on the printer carriage 12 in a state clamped between the resilient arms 22 and 24, the roller 20 is engaged with the coupling member 38 and pushes it down in FIG. 2 against the spring force of a spring 39. When the roller 20 or shaft 25 is subsequently rotated, the roller 20 and coupling member 38 are brought into an operatively coupled condition due to the spring force of the spring 39. When this state is brought about, the rotation of the shaft 25 is transmitted through the coupling member 38 to the roller 20. Although not shown in the FIG. 2 for the sake of brevity, the roller 20 is rotatably mounted in the ribbon cassette 18 to drive an endless ink ribbon (not shown) accommodated in the ribbon cassette 18 in co-operation with a separate roller (not shown) rotatably provided in the cassette 18.

Figure 3:
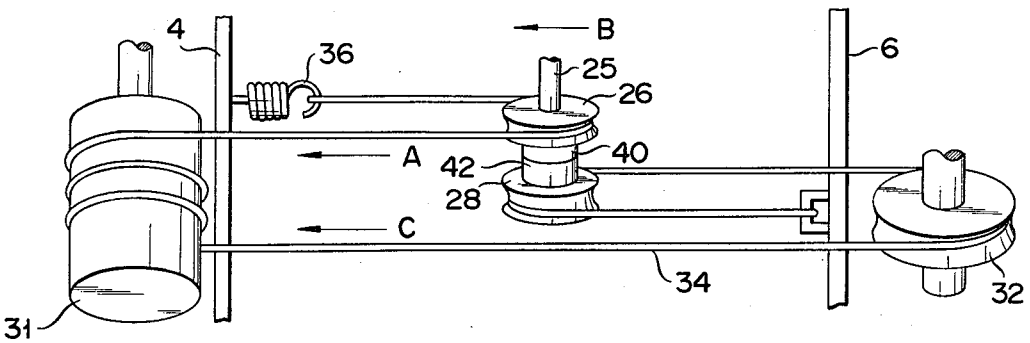
FIG. 3 is a schematic view showing the arrangement of component parts constituting the drive mechanism shown in FIG. 1.

When the cord 34 is pulled in the direction of arrow A in FIG. 3 with the rotation of the motor shaft 31, the pulleys 26 and 28 are moved in the direction of arrow B while being rotated in the clockwise direction and counterclockwise direction respectively in frictional contact with the cord 34. At this time, the clockwise rotation of the pulley 26, for instance, is transmitted through the one-way clutch 40 to the shaft 25 to cause clockwise rotation of the shaft 25, thus causing the clockwise rotation of the roller 20 coupled to the shaft 25 through the coupling member 38 to cause transfer of the ink ribbon in a predetermined direction. When the cord 34 is pulled in the direction of arrow C in FIG. 3, the pulleys 26 and 28 are moved in the direction opposite to the direction of arrow B while being rotated in the counterclockwise direction and clockwise direction respectively. At this time, the clockwise rotation of the pulley 28 is transmitted through the one-way clutch 42 to the shaft 25 to cause clockwise rotation of the shaft 25. Thus, the roller coupled to the shaft 25 is rotated in the clockwise direction to cause the transfer of the ink ribbon in the same direction as mentioned before.

As has been shown, in this embodiment the rotation of the shaft 25 for driving the printer carriage 10 along the platen 8 is selectively transmitted to the ribbon feed roller 20 through the one-way clutches 40 and 42, no exclusive drive mechanism for the ribbon feed roller 20 is required, and the ink ribbon can be efficiently fed with a reduced number of parts.

While a preferred embodiment of the invention has been described above, it is by no means limitative. For example, while in the above embodiment the roller 20 is rotated in a predetermined direction whenever the printer carriage 10 is driven in whichever direction, it may be rotated in a predetermined direction only when the printer carriage 10 is driven in a predetermined direction. Such arrangements are shown in FIGS. 5 and 6.

Figure 5:
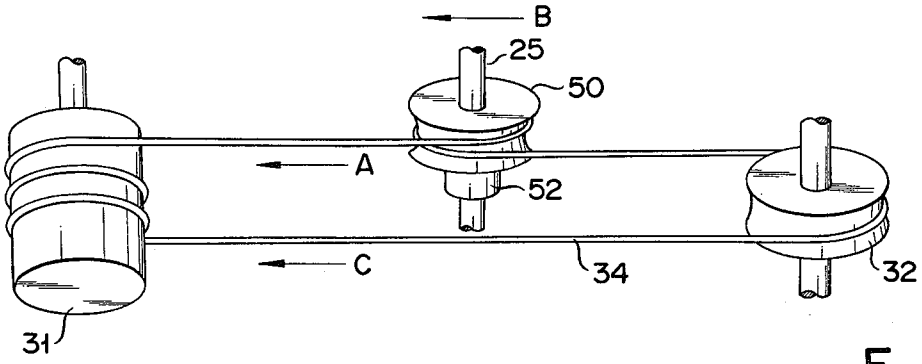
FIG. 5 is a schematic view showing another embodiment of the drive mechanism according to the invention.

In the drive mechanism as schematically shown in FIG. 5, printer carriage 10 is moved along platen 8, and a pulley 50 and a one-way clutch 52 mounted on rotatable shaft 25 are used to rotate a ribbon feed roller 20 in a predetermined direction. In this drive mechanism, a cord 34 is an endless cord, and it is wound on motor shaft 31 several turns, wound one turn on the pulley 50 and stretched on the pulley 32. When this cord 34 is pulled in the direction of arrow A in FIG. 5, the pulley 50 is moved in the direction of arrow B while being rotated in the clockwise direction. At this time, the clockwise rotation of the pulley 50 is transmitted through the one-way clutch 52 to the shaft 25 to cause rotation of the ribbon feed roller 20 in a predetermined direction (FIGS. 1 and 2). When the cord 34 is pulled in the direction of arrow C, the pulley 50 is moved in the direction opposite to the direction of arrow B while being rotated in the counterclockwise direction. At this time, the counterclockwise rotation of the pulley 50 is not transmitted to the shaft 25, so that the ribbon feed roller 20 is not rotated.

Figure 6:
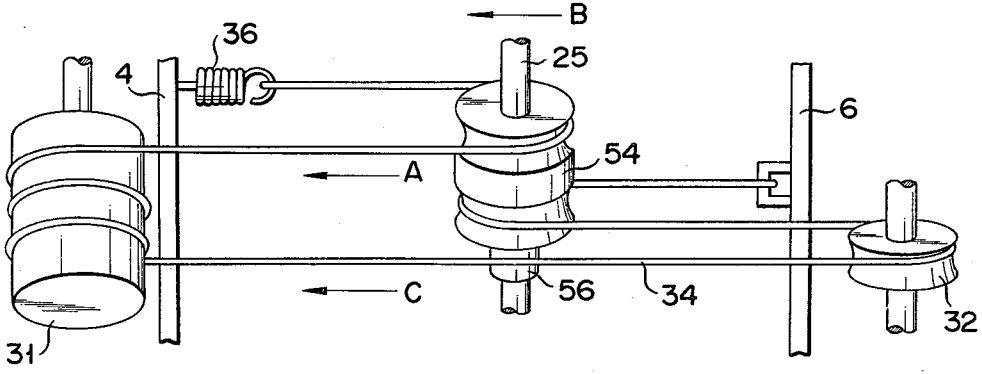
FIG. 6 is a schematic view showing a further embodiment of the drive mechanism according to the invention.

In the drive mechanism shown in FIG. 6, printer carriage 10 is moved along platen 8, and a pulley 54 and a one-way clutch 56 mounted on rotatable shaft 25 are used for rotating ribbon feed roller 20 in a predetermined direction. In this drive mechanism, a cord 34 is connected at one end to side wall 4, and it is passed round the pulley 54, wound several turns on a motor shaft 31 and stretched on pulleys 32 and 54. The other end of the cord is connected to side wall 6. When the cord 34 is pulled in the direction of arrow A, the pulley 54 is moved in the direction of arrow B while being rotated in the clockwise direction. At this time, the clockwise rotation of the pulley 54 is transmitted through the one-way clutch 51 to the shaft 25 to cause rotation of the ribbon feed roller 20 in a predetermined direction (FIGS. 1 and 2). When the cord 34 is pulled in the direction of arrow C, the pulley 54 is moved in the direction opposite to the direction of arrow B while being rotated in the counterclockwise direction. At this time, the counterclockwise rotation of the pulley 54 is not transmitted to the shaft 25, so that the ribbon feed roller 20 is not rotated.

Further, the cord 34 in the drive mechanism shown in FIG. 3 or 5 may be replaced with a combination of a cord, which is connected at one end to the spring 36, passed round the pulley 26 or 54 and connected at the other end to the motor shaft 31 after being wound thereon one turn or several turns, and another cord, which is connected at one end to the side wall 6 and connected at the other end to the motor shaft 31 after being wound thereon one turn or several turns. Also, in lieu of the endless cord 34 in the drive mechanism shown in FIG. 4, a cord which is secured at the opposite ends to the motor shaft 31 may be used.

Further, while in the above embodiments the one-way clutches 52 and 56 are used for transmitting the rotation of the pulleys 50 and 54 to the shaft 25, it is possible to secure the pulleys 50 and 54 to the shaft 25 and use a one-way clutch for selectively transmitting the rotation of the shaft 25 to the roller 20.

Further, where one-way clutches are used, there is no need to use bearings between the pulleys 26 and 28 and shaft 25 as shown in FIG. 4.

What is claimed is:

1. A drive mechanism for printer carriage and printing ribbon comprising:

a rotatable ribbon feeding member adapted to feed a printing ribbon carried in a cassette;

a carriage moving member adapted to be rotatably mounted on a printer carriage;

a cord-like member provided in frictional contact with said carriage moving member;

drive means for driving said cord-like member for thereby moving said carriage moving member along a printing line while causing rotation of said carriage moving member; and one-way clutch means for transmitting the rotation of said carriage moving member in a predetermined direction to said rotatable ribbon feeding member.

2. A drive mechanism according to claim 1, wherein said carriage moving member includes a rotatable shaft rotatably mounted on said printer carriage and a first pulley rotatably mounted on said rotatable shaft, and also wherein said one-way clutch means includes a one-way clutch for transmitting the rotation of said first pulley in a predetermined direction to said rotatable shaft and a member for drivingly coupling said rotatable shaft and said ribbon feeding member to each other.

3. A drive mechanism according to claim 2, wherein said drive means includes a motor shaft and a second pulley mounted on the side of said first pulley which is opposite to said motor shaft such that said first pulley is interposed between said motor shaft and said second pulley, said cord-like member being wound on said first pulley and having one portion wound on said motor shaft and another portion wound on said second pulley.

4. A drive mechanism according to claim 3, wherein said cord-like member is an endless cord.

5. A drive mechanism according to claim 2, wherein said drive means includes a motor shaft and a second pulley mounted on the side of said first pulley which is opposite to said motor shaft such that said first pulley is interposed between said motor shaft and said second pulley, said cord-like member including a first cord section having one end secured in position on the same side as said motor shaft with respect to said first pulley and another end wound on said motor shaft after being stretched on said first pulley, and a second cord section having one end secured in position on the side opposite to said motor shaft with respect to said first pulley and another end wound on said motor shaft after being stretched on said first pulley and said second pulley in the mentioned order.

6. A drive mechanism according to claim 5, wherein said another ends of said first and second cord sections are coupled to each other.

7. A drive mechanism according to claim 5 or 6, wherein said drive means includes a spring having two ends, one end of said first cord section being coupled to one end of said spring, and the other end of said spring being secured in position.

8. A drive mechanism according to any one of claims 1 or 6, wherein said first pulley is mounted on said rotatable shaft via a bearing.

9. A drive mechanism for printer carriage and printing ribbon comprising:

a rotatable ribbon feeding member adapted to feed a printing ribbon carried in a cassette;

a carriage moving member adapted to be rotatably mounted on a printer carriage, said carriage moving member including a rotatable shaft rotatably mounted on said printer carriage and drivingly coupled with said rotatable ribbon feeding member; and first and second pulleys rotatably mounted on said rotatable shaft of said carriage moving member;

a cord-like member provided in frictional contact with said first and second pulleys to cause said first and second pulleys to rotate in opposite directions in accordance with movement of said cord-like member;

drive means for movingly driving said cord-like member to thereby move said carriage moving member along a printing line and also causing said first and second pulleys to rotate in said opposite directions; and one-way clutch means including first and second one-way clutches coupled respectively to said first and second pulleys for transmitting said rotation of said first and second pulleys in a predetermined direction to said rotatable shaft.

10. A drive mechanism according to claim 9, wherein said drive means includes a motor shaft and a third pulley mounted on the side of said first and second pulleys which is opposite to said motor shaft such that said first and second pulleys are interposed between said motor shaft and said third pulley, said cord-like member including a first cord section having one end secured in position on the same side as said motor shaft with respect to said first and second pulleys and another end wound on said motor shaft after being stretched on said first pulley, and a second cord section having one end secured in position on the side opposite to said motor shaft with respect to said first and second pulleys and another end wound on said motor shaft after being stretched on said second and third pulleys in the mentioned order, said first and second pulleys being rotated in opposite directions by said cord sections when said first and second pulleys are being moved along a line of printing by said cord sections.

11. A drive mechanism according to claim 10, wherein said another ends of said first and second cord sections are coupled to each other.

12. A drive mechanism according to claim 10 or 11, wherein said drive means includes a spring having two ends, one end of said spring being secured in position and the other end of said spring being coupled to one end of said first cord section.

13. A drive mechanism according to any one of claims 9, 10 or 11, wherein at least one of said first and second pulleys is mounted on said rotatable shaft via a bearing.

* * * * *